US008294119B2

(12) United States Patent
Arscott et al.

(10) Patent No.: US 8,294,119 B2
(45) Date of Patent: Oct. 23, 2012

(54) PLANAR ELECTRONEBULIZATION SOURCES MODELED ON A CALLIGRAPHY PEN AND THE PRODUCTION THEREOF

(75) Inventors: Steve Arscott, Lille (FR); Severine Le Gac, Ormesson sur Marne (FR); Christian Druon, Villeneuve d'Ascq (FR); Christian Rolando, Lille (FR)

(73) Assignees: Universite des Sciences et Technologies de Lille, Villeneuve d'Ascq (FR); Centre National de la Recherche Scientifique, Paris (FR)

( * ) Notice: Subject to any disclaimer, the term of this patent is extended or adjusted under 35 U.S.C. 154(b) by 372 days.

(21) Appl. No.: 10/578,879

(22) PCT Filed: Nov. 10, 2004

(86) PCT No.: PCT/FR2004/050580

§ 371 (c)(1),
(2), (4) Date: Mar. 9, 2007

(87) PCT Pub. No.: WO2005/046881

PCT Pub. Date: May 26, 2005

(65) Prior Publication Data

US 2007/0252083 A1 Nov. 1, 2007

(30) Foreign Application Priority Data

Nov. 12, 2003 (FR) ..... 03 50820

(51) Int. Cl.
*H01J 49/00* (2006.01)
*H01J 49/10* (2006.01)

(52) U.S. Cl. ..... 250/424; 250/423 R; 250/425; 250/281; 250/282; 250/288

(58) Field of Classification Search ..... 250/288, 250/281, 282, 423 R, 424, 425
See application file for complete search history.

(56) References Cited

U.S. PATENT DOCUMENTS

| | | | | |
|---|---|---|---|---|
| 5,165,601 | A | 11/1992 | Rodenberger et al. | |
| 5,994,696 | A * | 11/1999 | Tai et al. | 250/288 |
| 6,602,472 | B1 | 8/2003 | Zimmermann et al. | |
| 6,633,031 | B1 * | 10/2003 | Schultz et al. | 250/288 |

FOREIGN PATENT DOCUMENTS

| | | |
|---|---|---|
| JP | B-S63-46139 | 12/1988 |
| JP | 2001-343361 | 12/2001 |

OTHER PUBLICATIONS

International Search Report dated Mar. 31, 2005.
Japanese language Office Action, with English language translation, mailed Dec. 14, 2010 in corresponding Japanese Application No. 2006-538911.

* cited by examiner

*Primary Examiner* — Michael Maskell
*Assistant Examiner* — Hanway Chang
(74) *Attorney, Agent, or Firm* — Buchanan Ingersoll & Rooney PC

(57) ABSTRACT

The invention concerns an electrospray source having a structure comprising at least one flat and thin tip (3) in cantilever in relation to the rest (1) of the structure, the tip (3) being provided with a capillary slot (5) formed through the complete thickness of the tip and which ends up at the end (6) of the tip (3) to form an ejection orifice of the electrospray source, the source comprising means of supplying (4) the capillary slot (5) with liquid to be nebulised and means of applying an electrospray voltage to the liquid.
The invention further concerns a method of manufacturing said electrospray source.

17 Claims, 10 Drawing Sheets

PLANAR ELECTRONEBULIZATION SOURCES MODELED ON A CALLIGRAPHY PEN AND THE PRODUCTION THEREOF

FIELD OF THE INVENTION

The present invention concerns original electrospray sources, their method of manufacture and their applications.

BACKGROUND OF THE INVENTION

State of the Prior Art

Electrospraying is the phenomenon that transforms a liquid into a nebulisate under the action of a high voltage (M. CLOUPEAU "Electrohydrodynamic spraying functioning modes: a critical review. Journal of Aerosol Science (1994), 25(6), 1021-1036"). To achieve this, the liquid is conveyed into a capillary and is subjected to a high direct current or alternating current voltage or to a superposition of the two (Z. HUNEITI et al., "The study of AC coupled DC fields on conducting liquid jets", Journal of Electrostatics (1997), 40 & 41 97-102). At the capillary output, the liquid is nebulised under the action of the voltage. The surface of the meniscus formed by the liquid is stretched to form one or several Taylor cones from which are ejected charged droplets of liquid, which develop to give a gas containing charged particles. The formation of the nebulisate is observed when the electrical forces due to the application of the voltage compensate and exceed the surface tension forces of the liquid on the section of the capillary in the end of said capillary.

The size of the capillary, and more precisely its output orifice, is in direct relation to the flow of liquid coming out of the capillary and the voltage to be applied to observe the phenomenon of nebulisation. Two distinct electrospraying operating conditions exist, which are distinguished by their establishment characteristics:

- The operating conditions termed conventional, which correspond to capillary output sizes of 100 μm, fluid flow rates in the range 1-20 μL/min and high voltages of 3-4 kV;
- The operating conditions known as nanoelectrospray where the flows of liquid are less than 1 μL/min, the high voltage around 1 kV and the internal diameters of the capillaries 1-10 μm (M. WILM et al, "Analytical Properties of the Nanoelectrospray Ion Source", Analytical Chemistry (1996), 68(1), 1-8.).

The application of a voltage having an alternating component allows the stabilisation of the electrospraying process by synchronisation on its own frequency (F. CHARBONNIER et al., "Differentiating between Capillary and Counter Electrode Methods during Electrospray Ionization by Opening the Short Circuit at the Collector". Analytical Chemistry (1999), 71(8), 1585-1591). The chemical composition of the drops produced by the electrospray phenomenon may be improved in view of its applications by the application of multiple and independent voltages that enable the chemical modification of the species present in the liquid by electrochemistry (see US patent application 2003/0015656; G. J. VAN BERKEL, "Enhanced Study and Control of Analyte Oxidation in Electrospray Using a Thin-Channel, Planar Electrode Emitter", Analytical Chemistry (2002), 74(19), 5047-5056; G. J. VAN BERKEL et al., "Derivatization for electrospray ionization mass spectrometry. 3. Electrochemically ionizable derivatives", Analytical Chemistry (1998), 70(8), 1544-1554; F. ZHOU et al. "Electrochemistry Combined Online with Electrospray Mass Spectrometry", Analytical Chemistry (1995), 67(20), 3643-3649).

The application fields of electrospraying are as follows:

- Firstly, the ionisation of molecules (M. DOLE et al., "Molecular beams of macroions", Journal of Chemical Physics (1968), 49(5), 2240-2249; L. L. MACK et al., "Molecular beams of macroions. II", Journal of Chemical Physics (1970), 52(10), 4977-4986; U.S. Pat. No. 4,209,696; M. YAMASHITA et al., "Electrospray ion source. Another variation on the free-jet theme", Journal of Physical Chemistry (1984), 88(20), 4451-4459; M. YAMASHITA et al., "Negative ion production with the electrospray ion source", Journal of Physical Chemistry (1984), 88(20), 4671-4675) before their analysis by mass spectrometry as a function of the ratio m/z, where m is the mass of the analyte and z its charge. In this case, the flow of liquid is continuous.
- A second application of electrospray devices is the production of drops of calibrated size. Such drops may be deposited on a support (C. J. McNEAL et al., "Thin film deposition by the electrospray method for californium-252 plasma desorption studies of involatile molecules", Analytical Chemistry (1979), 51(12), 2036-2039; R. C. MURPHY et al., "Electrospray loading of field desorption emitters and desorption chemical ionization probes", Analytical Chemistry (1982), 54(2), 336-338) for example a wafer for, either the production of analysis chips such as DNA or peptide chips, dedicated to a high rate analysis (V. N. MOROZOV et al., "Electrospray Deposition as a Method for Mass Manufacture of Mono- and Multicomponent Microarrays of Biological and Biologically Active Substances", Analytical Chemistry (1999), 71(15), 3110-3117; R. MOERMAN et al., "Miniaturized electrospraying as a technique for the production of microarrays of reproducible micrometer-sized protein spots", Analytical Chemistry (2001 May 15), 73(10), 2183-2189; N. V. AVSEENKO et al., "Immunoassay with Multicomponent Protein Microarrays Fabricated by Electrospray Deposition", Analytical Chemistry (2002), 74(5), 927-933), or the deposition of solutions on a MALDI wafer (for "Matrix Assisted Laser Desorption Ionization") before an analysis by mass spectrometry (J. AXELSSON et al., "Improved reproducibility and increased signal intensity in matrix-assisted laser desorption/ionization as a result of electrospray sample preparation", Rapid Communications in Mass Spectrometry (1997), 11(2), 209-213). These drops may also be handled, either for the injection of liquid into a hydrodynamic balance for handling unique drops (M. J. BOGAN et al., "MALDI-TOF-MS analysis of droplets prepared in an electrodynamic balance: "wall-less" sample preparation", Analytical Chemistry (2002), 74(3), 489-496), or for their collection to lead to encapsulated molecules or with a metastable crystalline state (I. G. LOSCERTALES et al., "Micro/nano encapsulation via electrified coaxial liquid jets", Science (Washington, D.C., United States) (2002), 295(5560), 1695-1698). Here, the ejection takes place in a discrete manner, the dimensions of the sources largely depending on the size of the depositions to be formed.
- A third application is the deposition of particles of controlled size contained within the liquid (I. W. LENGGORO et al., "Sizing of Colloidal Nanoparticles by Electrospray and Differential Mobility Analyzer Methods", Langmuir (2002), 18(12), 4584-4591). The particles may also be replaced by cells for the preparation of cell chips.

A fourth application is the injection of drops formed by electrospraying in a liquid leading to emulsions of well defined size (R. J. PFEIFER et al., "Charge-to-mass relation for electrohydrodynamically sprayed liquid droplets", Physics of Fluids (1958-1988) (1967), 10(10), 2149-54; C. TSOURIS et al., "Experimental Investigation of Electrostatic Dispersion of Nonconductive Fluids into Conductive Fluids", Industrial & Engineering Chemistry Research (1995), 34(4), 1394-1403; R. HENGELMOLEN et al., "Emulsions from aerosol sprays", Journal of Colloid and Interface Science (1997), 196(1), 12-22).

A fifth application is molecular writing on a wafer by means of molecules or chemical solutions (S. N. JAYASINGHE et al., "A novel method for simultaneous printing of multiple tracks from concentrated suspensions", Materials Research Innovations (2003), 7(2), 62-64.), with a view to the functionalisation of the material or localised chemical treatment, at a scale that could be less than a micrometer.

These diverse applications may also be combined with each other.

Usually, the sources used for the nanoelectrospray are in the form of capillaries in glass or in fused silica. They are manufactured by hot drawing or by acid attack of the material in order to produce an output orifice of 1 to 10 μm (M. WILM et al., "Electrospray and Taylor-Cone theory, Dole's beam of macromolecules at last?", International Journal of Mass Spectrometry and Ion Methods (1994), 136(2-3), 167-180). The electrospray voltage may be applied via an appropriate exterior conductive coating: a metal coating such as gold or an Au/Pd alloy (G. A. VALASKOVIC et al., "Long-lived metalized tips for nanoliter electrospray mass spectrometry", Journal of the American Society for Mass Spectrometry (1996), 7(12), 1270-1272), silver (Y.-R CHEN et al., "A simple method for manufacture of silver-coated sheathless electrospray emitters", Rapid Communications in Mass Spectrometry (2003), 17(5), 437-441), a carbon based material (X. ZHU et al., "A Colloidal Graphite-Coated Emitter for Sheathless Capillary Electrophoresis/Nanoelectrospray Ionization Mass Spectrometry", Analytical Chemistry (2002), 74(20), 5405-5409) or a conductive polymer such as polyaniline (P. A. BIGWARFE et al., "Polyaniline-coated nanoelectrospray emitters: performance characteristics in the negative ion mode", Rapid Communications in Mass Spectrometry (2002), 16(24), 2266-2272). The electrospray voltage may also be applied via the liquid with the introduction of a metallic wire in the source (K. W. Y. FONG et al., "A novel nonmetallized tip for electrospray mass spectrometry at nanoliter flow rate", Journal of the American Society for Mass Spectrometry (1999), 10(1), 72-75).

Nevertheless, the devices of the prior art dedicated to nanoelectrospray suffer from several weaknesses (B. FENG et al., "A Simple Nanoelectrospray Arrangement With Controllable Flowrate for Mass Analysis of Submicroliter Protein Samples", Journal of the American Society for Mass Spectrometry (2000), 11, 94-99):

Firstly, these capillaries are not very robust. Their method of manufacture is poorly controlled and provides sources of not very reproducible dimensions;

The external conductive coating deteriorates rapidly;

Their mode of use is not very convenient due to their needle type geometry: the liquid to be nebulised has to be introduced manually into the needle by means of a micropipette and a suitable tip of tapered shape;

The loading of the solution leads to the introduction of air bubbles in the needle, which can perturb the stability of the nebulisate at a later stage, and therefore have to be dispelled;

Finally, most often, the output orifice is too small to allow the passage of the liquid; as a result, the capillaries must firstly be broken with care along one wall, which further increases the uncertain character of their dimensions.

Thus, standard commercial sources are poorly adapted, firstly to a nebulisation that is controlled, reproducible and of high quality, secondly to the use of robots due to the entirely manual character of their mode of use, and, thirdly, to an integration in a fluidic microsystem, as discussed hereafter.

These drawbacks hamper certain electrospraying application fields that require at the present time a robotisation and an automation of the processes. This is the case of the application fields enumerated above: analysis by mass spectrometry, deposition of drops of calibrated size and writing at a submicrometer scale by means of a tip.

The last two decades have witnessed the advent of microfluidics in the fields of chemistry and biology. This sector results in part from the miniaturisation of laboratory tools and thereby the marriage between microtechnology and biology or microtechnology and chemical analysis. Thus, microtechnology techniques are put to profit for the manufacture of integrated Microsystems of characteristic size of the order of a micrometer and which group together a series of rectional and/or analytical, chemical and/or biochemical/biological processes.

The development of microfluidics in the fields of chemistry and biology, where the rapidity and the automation of processes are today required, is explained by:

the gain in speed of the processes, due to the fact that the speed mainly depends on the size of the devices; this gain in speed is particularly important for medical diagnosis or environmental analysis type application fields, where an instantaneous response is often expected, the possibility of parallelisation of processes; microtechnology enables the simultaneous manufacture of a large number of identical devices, the compatibility of microfabricated objects with a robotic interface with a view to automating the processes, the appropriateness of the volumes handled with those available to the experimenter in the case, among others, of biological or environmental analyses, the limitation going up to the elimination of human intervention, which is often a source of error and contamination, a gain in sensitivity, for certain technical analyses, including mass spectrometry with an ionisation by electrospraying, all in all, new performances that do not only correspond to a reduction in scale of the tools and well established techniques.

Microfluidic devices are manufactured by means of microtechnology techniques. A wide range of materials is now available for these microfabrications, a range extending from silicon and quartz (normal materials in microtechnology) to glasses, ceramics and polymer type materials, such as elastomers or plastics. Thus, microfluidics benefit both from:

the legacy of materials and manufacturing techniques developed and used for microelectronic applications and, new methods of manufacture, developed in parallel and adapted to other emerging materials and of considerable interest for microfluidic applications, such as plastic type materials, the principal attraction of which resides in their low cost.

More precisely, the materials that may be envisaged for technological manufacture applicable to chemistry and biology are (T. McCREEDY, "Manufacture techniques and materials commonly used for the production of microreactors and micro total analytical systems", TrAC, Trends in Analytical Chemistry (2000), 19(6), 396-401):

semi-conductor type materials such as silicon, traditional materials in microtechnology that benefit from robust and proven manufacturing techniques; among these manufacturing techniques, one may cite lithography, physical and chemical etching among others (P. J. FRENCH et al., "Surface versus bulk micromachining: the contest for suitable applications", Journal of Micromechanics and Microengineering (1998), 8(2), 45-53). As a result, silicon in particular is the most interesting material in terms of manufacture of small structures at scales of ten or so nanometers. Moreover, its surface chemistry is mastered, the treatments bringing into play the silanol functions present on its surface. However, its semi-conductive properties are not always suited depending on the targeted applications. It is not transparent, which precludes any optical detection technique (absorbance UV, fluorescence, luminescence). The cost of the material itself renders it unsuitable for certain mass manufacturing (in particular, unique use objects).

quartz, used for the development of the first Microsystems (J. S. DANEL et al., "Quartz: a material for microdevices", Journal of Micromechanics and Microengineering (1991), 1(4), 187-98), which has become not very attractive due to its very high cost; therefore, it has been progressively abandoned despite its physical and chemical properties.

glass, a material less expensive than quartz and silicon, which is widely used due to its surface properties suited to the establishment of an electroosmotic flux (K. SATO et al., "Integration of chemical and biochemical analysis systems into a glass microchip", Analytical Sciences (2003), 19(1), 15-22). In the same way as for silicon, silanol groups cover the surface of the glass. They allow a subsequent chemical modification of the glass surfaces to be envisaged. Moreover, it properties of transparency make it a material of choice in the case of optical detection. However, the manufacturing techniques are not as well mastered as for silicon; the etching profiles are less clean cut and the aspect ratio is very mediocre (T. R. DIETRICH et al., "Manufacture technologies for microsystems utilizing photoetchable glass", Microelectronic Engineering (1996), 30(1-4), 497-504). Furthermore, it is a fragile and brittle material.

Polymer type materials, which group together plastics and elastomers. Their principal advantage is their low cost, which is compatible with mass productions at low cost price. The multiplicity of these materials leads to a wide range of physical and chemical properties. Their major disadvantage is their low resistance at high temperatures and their sensitivity to the solvent conditions conventionally used in chemistry and in biology, organic, acid and basic media that can lead to a degradation of the material or even its dissolution. Moreover, the surface chemistry of these materials is not well known, which makes difficult subsequent treatment of the surfaces brought about in order to modify their properties. The manufacturing techniques are completely different and are based on moulding/injection, laser ablation and LIGA techniques (German acronym for "Lithographie, Galvanoformung, Abformung") (J. HRUBY, "Overview of LIGA micromanufacture", AIP Conference Proceedings (2002), 625(High Energy Density and High Power RF), 55-61), photolithography, plasma etching.

Ceramic type materials (W. BAUER, "Ceramic materials in the microsystem technology", Keramische Zeitschrift (2003), 55(4), 266-270), which are inorganic substrates inexpensive to manufacture in the image of plastic materials. A major advantage is that their manufacture does not require dedicated equipment with expensive maintenance such as clean rooms but is based on simple and rapid processes (laser ablation, laminating, moulding, sol-gel method), further reducing the cost price of the microfabricated structures. Their surface condition is comparable to that of glass or silicon and finally, capping is easier than for other materials, such as glass.

In particular, micromanufacturing techniques have been applied to the formation of electrospray sources or of needle type tips with a view to:

improving the overall quality of the capillaries in terms of control of the manufacturing methods, reproducibility of sources and their dimensions, producing a large number of devices identical or different to each other by one or several dimensions, on a same wafer of material, in the image of microelectronic microcomponents, in order to promote the automation and robotisation of the electrospraying.

Manufacturing electrospray tips by means of microtechnology techniques obey two tendencies:

the manufacture of an electrospray tip that reproduces the conventional geometry, in other words a microfabricated capillary and, usually, of circular section. In this class may also be included microfabricated needles intended for another application, such as that of injecting chemical substances or measuring biological potential.

the design of an electrospray source as a microchannel or capillary output manufactured by means of microtechnology techniques and having a tapering profile.

These microfabricated electrospray devices are based, in the image of fluidic Microsystems, on the use of different types of materials and different types of methods.

According to the first tendency, which aims to produce by technological route a capillary type geometry, one can list the following descriptions:

According to this approach, electrospray sources in silicon nitride have been manufactured by means of traditional photolithography and etching techniques (A. DESAI et al., "MEMS Electrospray Nozzle for Mass Spectrometry", Int. Conf. on Solid-State Sensors and Actuators, Transducers '97, (1997)). The dimensions of said devices have a length of 40 μm and an internal diameter of the output orifice of 1 to 3 μm. Said sources have been tested by mass spectrometry at nebulisation voltages close to 4 kV and a flow of liquid of 50 mL/min with standard peptides at a concentration of several micromoles. The nebulisation voltage is applied upstream of said device, at the level of the junction with a liquid supply capillary, and this, on a platinum metal connection.

Electrospray sources manufactured in polymer type material, parylene, a photolithographic material, have also been described (international patent application WO-A-00/30167; L. LICKLIDER et al., "A Micromachined Chip-Based Electrospray Source for Mass Spectrometry", Analytical Chemistry (2000), 72(2), 367-375). These sources have an output orifice of 5×10 μm and have been described as an integral part of a fluidic microsystem in silicon. They are connected to microchannels of 100 μm width and, 5 μm height. The voltage required for the nebulisation is here lower, around 1.2 to 1.8 kV under equivalent concentration and fluid flow rate conditions; the voltage is applied to a metallic wire brought into contact with the solution to be nebulised.

Silicon has also been used for the micromanufacture of needle type structures. International patent application WO-A-00/15321 describes an electrospray device resembling a chimney, of internal diameter 10 μm for an external diameter of 20 μm and a height of 50 μm. One may also refer to the article of G. A. SCHULTZ et al., entitled "A Fully Integrated Monolithic Microchip Electrospray Device for Mass Spectrometry", Analytical Chemistry (2000), 72(17), 4058-4063. These sources result from a physical etching, known as deep etching, of the material. Their operation in electrospraying is described with high voltages of 1.25 kV, which are applied to the fluid supply capillary located at the rear of the source and which is in conductive material. The prototype has been described integrated on a wafer comprising 100 sources of this type, identical and operating independently of each other. Silicon and a similar method of manufacture have also been used to form needle type structures that are used either as electrospraying sources (P. GRISS et al., "Development of micromachined hollow tips for protein analysis based on nanoelectrospray ionization mass spectrometry", Journal of Micromechanics and Microengineering (2002), 12(5), 682-687; J. SJODAHL et al., "Characterization of micromachined hollow tips for two-dimensional nanoelectrospray mass spectrometry", Rapid Communications in Mass Spectrometry (2003), 17(4), 337-341), or as biological potential measurement needles (international patent application WO-A-03/15860; P. GRISS et al., "Micromachined electrodes for biopotential measurements", IEEE/ASME Journal of Microelectromechanical systems, 2001, 10, 10-16). Their shape varies a little as a function of their application; the electrospray devices resemble the devices in silicon described above, with nevertheless, a profile that narrows at their tip leading to a smaller output orifice, whereas the needles intended for biological potential measurements have a very tapered tip. The method of manufacturing said devices in silicon by means of deep etching techniques is very complex and necessitates a costly and bulky apparatus and the performance, in terms of nebulisation voltage among others, of the structures obtained are mediocre compared to those of standard commercial sources. Moreover, their geometry does not lend itself well to integration in a fluidic microsystem.

The article of L. LIN et al., entitled "Silicon processed microneedles", IEEE Journal of Microelectromechanical Systems (1999), 8, 78-84) describes microneedles that are connected to a microfluidic network. These needles have been developed for the injection of chemical substances in situ and not for nebulisation, but the needle type geometry of these devices is similar to that of nanospray sources. These needles are manufactured in silicon nitride and have a rectangular output orifice of 9×30-50 μm and a height of 1 to 6 mm.

Needle type structures have finally been manufactured in another polymer material, polycarbonate, by means of a laser ablation method (K. TANG et al., "Generation of multiple electrosprays using microfabricated emitter arrays for improved mass spectrometric sensitivity", Analytical Chemistry (2001), 73(8), 1658-1663). Their dimensions are as follows: 30 μm internal diameter in their output orifice and 250 μm high. In this example again, the dimensions of said devices are too high for an operating condition in nanoelectrospray since the voltage required for the observation of a nebulisate is 7 kV and the flow rate of fluid is estimated at 30 μL/min. The method of manufacture is moreover complex. These sources are in the form of a series of nine sources arranged along a 3×3 square. They operate simultaneously and nebulise the same solution.

The second tendency is to machine a tip at the output of a microchannel or to create a tip structure that acts as electrospray source. The angle of the tip structure does not seem to have any influence on the nebulisation phenomenon. According to this second tendency:

Nebulisation attempts at the output of a microchannel, on the wafer of a microsystem, have turned out not to be very conclusive. The voltage to be applied is very high and, under these conditions, the liquid has a tendency to spread out on the output surface, on the wafer of the microsystem (R. RAMSEY et al., "Generating Electrospray from Microchip Devices Using Electroosmotic Pumping", Analytical Chemistry (1997), 69(6), 1174-1178; Q. XUE et al., "Multichannel Microchip Electrospray Mass Spectrometry", Analytical Chemistry (1997), 69(3), 426-430; B. ZHANG et al., "Microfabricated Devices for Capillary Electrophoresis-Electrospray Mass Spectrometry", Analytical Chemistry (1999), 71(15), 3258-3264). These tests have been improved by an appropriate chemical treatment of the output surface or by assisting, in a pneumatic manner, the formation of the nebulisate. This demonstrates the importance of working with a tip structure that leads to a concentration of the electric field and which thereby allows the nebulisation.

The point effect may be achieved by insertion of a planar triangular structure between the two wafers of materials defining a microchannel (the support in which the microchannel is machined and the cover). This planer triangular structure plane is composed of a sheet of parylene 5 μm thick (J. KAMEOKA et al., "An electrospray ionization source for integration with microfluidics", Analytical Chemistry (2002), 74(22), 5897-5901). The system integrates four identical electrospray devices placed in parallel. The required nebulisation voltage is 2.5-3 kV for a flow rate of fluid of 300 mL/min. No intersource interference has been observed.

A device in the form of an eight-branched star has been manufactured in polymethylmethacrylate (PMMA) (C.-H. YUAN et al., "Sequential Electrospray Analysis Using Sharp-Tip Channels Fabricated on a Plastic Chip", Analytical Chemistry (2001), 73(6), 1080-1083). Each of the branches of the star constitutes an independent microfluidic system and the tip of each branch is a nebulisation source. Each branch thus integrates a microchannel of section 300×376 μm, the tip structure forms an angle of 90° and the eight reservoirs of liquid are grouped together in the centre of the star. The voltage applied to establish a Taylor cone is high and equal to 3.8 kV, which is explained by the very large dimensions of the section of microchannel at its end. Moreover, the method of manufacture described is based on the machining of channels by means of a knife, a technique that does not enable channels and nebulisation devices of small dimensions to be formed.

Another polymer type material, polydimethylsiloxane (PDMS), has been used in the formation of tip structures intended for electrospraying according to three different microtechnological routes, a method based on the ablation of material, a method using a double layer of photolithographic resin and a resin moulding method (international patent application WO-A-02/55990; J. S. KIM et al., "Micromanufacture of polydimethylsiloxane electrospray ionization emitter", Journal of Chromatography, A (2001), 924(1-2), 137-145; J.-S. KIM et al., "Microfabricated PDMS multichannel emitter for electrospray ionization mass spectrometry", Journal of the American Society for Mass Spectrometry (2001), 12(4), 463-469; J.-S. KIM et al., "Miniaturized multichannel electrospray ionization emitters on poly(dimethylsiloxane) microfluidic devices", Electrophoresis (2001), 22(18), 3993-3999). The nebulisation orifice is rectangular and of variable dimensions ranging from 30×100 μm to 30×50 μm depending on the microtechnology method used for their manufacture. In the different cases, the nebulisation voltage ranged from 2.5 kV to 3.7 kV for 1 to 10 μM solutions and high flow rates of several 100mL/min to several μL/min.

Finally, polyimide, another relatively hydrophobic polymer type material has been used for the manufacture of nebulisation sources (GB-A-2 379 554; V. GOBRY et al., "Microfabricated polymer injector for direct mass spectrometry coupling", Proteomics (2002), 2(4), 405-412; J. S. ROSSIER et al., "Thin-chip microspray system for high-performance Fourier-transform ion-cyclotron resonance mass spectrometry of biopolymers", Angewandte Chemie, International Edition (2003), 42(1), 54-58) integrated on a microsystem, or at the very least, connected to a microchannel of section 120×45 μm. The system, the microchannel and the tip structure are manufactured by plasma etching of the polyimide. The cover of the system is in polyethylene/polyethylene terephthalate. The operation of said electrospray sources has been validated for standard 5 μM samples of peptides, flowing at 140 mL/min and for nebulisation voltages from 1.6 to 1.8 kV. Another device manufactured in the same material has been described, different from the previous one by its open topology and the finesse of the thickness (50 μm) of material used for its manufacture. This structure termed thin has been tested for ionization voltages from 1 to 2.3 kV applied here on a carbon electrode integrated on the device.

All in all, the nebulisation devices detailed above have operating conditions that are not compliant for a small scale nebulisation (dimensions too big, nebulisation voltages too high) and most usually result from very complex manufacturing methods. In addition, the type of structure chosen for these different devices is practically indissociable from the material used for their formation.

For the different devices presented above, the nebulisation voltage is usually applied at the level of the reservoir of the device, if the system includes a reservoir, or, if this is not the case, at the level of the supply of liquid, which is achieved by means of a capillary connected to the device. In this case, either the capillary is conductive (in stainless steel for example), or the connection is based on a metallic connection. However, it has been proposed to integrate, on the nebulisation device, an electrode or conductive zone to which is applied the nebulisation voltage (T. C. ROHNER et al., "Polymer microspray with an integrated thick-film microelectrode", Analytical Chemistry (2001), 73(22), 5353-5357). This conductive zone is formed on the basis of carbon ink in the example cited.

Finally, the application of these devices is targeted for electrospraying preceding an analysis by mass spectrometry and does not lend itself to another type of application.

Moreover, the devices for depositing calibrated drops stemming from microtechnology are not based on the nebulisation of the solution but on a mechanical effect with the bringing into contact of the tip microfabricated on the deposition surface. Thus:

A structure miming that of a dip pen has been described for the elaboration of wafers of DNA chip type with the regular deposition of calibrated drops on a smooth surface (see international patent application WO-A-03/53583). The device comprises a trench etched in the material ending on a tip through which the liquid exits. This structure is known as flexible and the liquid to be deposited exits by bringing into contact the flexible tip with the deposition substrate, the contact angle being 20-30° in relation to the vertical. The major application targeted by this invention is the preparation of DNA chips or other compounds to be analysed.

P. BELAUBRE et al. in the article "Manufacture of biological microarrays using microcantilevers", Applied Physics Letters (2003), 82(18), 3122-3124, propose an open beam type structure for the deposition of drops of reproducible size. The application of the device is the preparation of DNA or protein chips in an automated manner. The beam type structure is firstly immersed in the solution to be deposited, then is brought into contact with the deposition surface. The ejection of the liquid is brought about by bringing the tip and said surface into contact. A specific feature of this device is the integration in the beam type structure of aluminium electrodes that make it possible to increase the liquid loading of the tip when it is soaked in the solution to be deposited, by electrostatic effect. These beam type structures, which have a width of 210 μm at their tip, are manufactured in parallel on a same system. They enable the ejection of drops having a volume in the range from femtoliter up to picoliter, the volume deposited depends linearly on the contact time between the tip and the surface, with a rate that can reach 100 depositions per minute.

Finally, molecular writing at around the nanometer scale is principally described with an AFM (Atomic Force Microscopy) tip which is soaked in a chemical solution, in the image of a dip pen (G. AGARWAL et al., "Dip-Pen Nanolithography in Tapping Mode", Journal of the American Chemical Society (2003), 125(2), 580-583; international patent applications WO-A-03/48314 and WO-A-03/52514; H. ZHANG et al., "Direct-write dip-pen nanolithography of proteins on modified silicon oxide surfaces", Angewandte Chemie, International Edition (2003), 42(20), 2309-2312; L. FU et al., "Nanopatterning of "Hard" Magnetic Nanostructures via Dip-Pen Nanolithography and a Sol-Based Ink", Nano Letters (2003), 3(6), 757-760; H. ZHANG et al., "Manufacture of sub-50-nm solid-state nanostructures on the basis of dip-pen nanolithography", Nano Letters (2003), 3(1), 43-45). The writing then takes place by bringing into contact or after coming together, depending on the mode of use of the selected AFM, of the tip and a smooth surface. The chemical solution may also be a solution that attacks the material on which it is deposited and thus serve for the etching of channels or other structures. The AFM technique has the advantage of high resolution and a very high writing precision. Three operating modes are possible and, depending on the mode chosen, the surface state may be controlled before and after passage of the molecular writing chemical solution. Nevertheless, this technique imposes the use of a heavy, bulky, costly and complex apparatus.

Two molecular writing devices described in the literature may also be cited. They derive from the technique using an AFM tip but are based on the use of a microfabricated tip. The first device (A. LEWIS et al., "Dip pen nanochemistry: Atomic force control of chrome etching", Applied Physics Letters (1999), 75(17), 2689-2691; H. TAHA et al., "Protein printing with an atomic force sensing nanofountainpen", Applied Physics Letters (2003), 83(5), 1041-1043), is in the form of a micropipette manufactured by means of microtechnology techniques and in which the tip may have dimensions as small as 3 and 10 nm for its internal and external diameters respectively. This micropipette is nevertheless integrated in an AFM apparatus for its use. The ejection of the solution is here provoked not by a bringing into contact but by applying a pressure on the column of liquid. This device has been tested for its aptitude to deliver etching solutions of a layer of chrome deposited on a glass wafer. The second device (I. W. RANGELOW et al., ""NANOJET": Tool for the nanomanufacture", Journal of Vacuum Science & Technology, B: Microelectronics and Nanometer Structures (2001), 19(6), 2723-2726; J. VOIGT et al., "Nanomanufacture with scanning nanonozzle 'Nanojet' ", Microelectronic Engineering (2001), 57-58 1035-1042) consists in tips formed in silicon covered with Cr/Au, having a pyramidal shape and an output orifice of size inferior to 100 nm. This device delivers not a chemical solution as in the previous example, but free radicals in the gas phase produced by a plasma discharge that attacks the material placed opposite the tip. Thus, the device does not consist uniquely in a microfabricated tip but also includes a machinery for producing very reactive species, such as radiofrequency or microwave plasma discharge, which can attack the substrate.

These two examples indeed have a microfabricated tip that replaces the conventional AFM tip, but they do not allow one to do away with the heavy and costly peripheral machinery necessary for their operation. Furthermore, this technique is based on a bringing into contact or quasi-bringing into contact of the tip and the substrate. Consequently, the operating parameters must be very meticulously controlled in order to avoid any deterioration in the surface condition due to too high a force applied at the level of the tip.

SUMMARY OF THE INVENTION

The present invention concerns a two dimensional electrospray device having a calligraphic pen type geometry, the tip of which acts as the site for the nebulisation.

The subject of the invention is therefore an electrospray source having a structure comprising at least one flat and thin tip in cantilever in relation to the rest of the structure, said tip being provided with a capillary slot formed through the complete thickness of the tip and which ends at the end of the tip to form the ejection orifice of the electrospray source, the source comprising means of supplying the capillary slot with liquid to be nebulised and means of applying an electrospray voltage to said liquid.

According to an advantageous embodiment, the supply means comprise at least one reservoir in fluidic communication with the capillary slot.

Preferably, the structure comprises a support and a wafer integral with the support and in which a part constitutes said tip. The supply means may comprise a reservoir constituted by a recess formed in said wafer and in fluidic communication with the capillary slot.

The means of application of an electrospray voltage may comprise at least one electrode arranged so as to be in contact with said liquid to be nebulised.

In the case where the structure comprises a support and a wafer integral with the support, the means of applying an electrospray voltage may comprise the support, at least partially electrically conductive, and/or the wafer at least partially electrically conductive. Advantageously, the wafer has a surface hydrophobic to the liquid to be nebulised.

The means of applying an electrospray voltage may comprise an electrically conductive wire arranged in order to be able to be in contact with said liquid to be nebulised.

The supply means may comprise a capillary tube. They may comprise a channel formed in a microsystem supporting said structure and in fluidic communication with the capillary slot.

According to an advantageous embodiment, the means of applying the voltage (electrode, support, wafer, wire) also enable the application of the voltages necessary for any device placed upstream in fluidic continuity with the subject of the present invention.

A further subject of the invention is a manufacturing method of a structure being an electrospray source, comprising:

- the formation of a support from a substrate,
- the formation of a wafer having a part constituting a flat and thin tip, said tip being provided with a capillary slot, to convey a liquid to be nebulised, formed through the complete thickness of the tip and which ends up at the end of the tip,
- making said wafer integral on the support, the tip being in cantilever in relation to the support.

This method may comprise the following steps:

- the provision of a substrate to form the support,
- the delimitation of the support by means of trenches etched in the substrate,
- the deposition, on a zone of the substrate corresponding to the future tip of the structure, of sacrificial material according to a determined thickness,
- the deposition of the wafer on the support delimited in the substrate, the tip of the wafer being situated on the sacrificial material,
- the elimination of the sacrificial material,
- the detachment of the support in relation to the substrate by cleavage at the level of said trenches.

The step of deposition of the wafer may be a deposition of a wafer comprising a recess in fluidic communication with the capillary slot in order to constitute a reservoir. The method may further comprise a step of depositing at least one electrode intended to assure an electrical contact with the liquid to be nebulised.

The electrospray source according to the invention may be used to obtain an ionisation of a liquid by electrospraying before its analysis by mass spectrometry. It can also be used to obtain a production of drops of liquid of calibrated size or the ejection of particles of fixed size. It can also apply to the carrying out of molecular writing by means of chemical compounds. It may also be applied to the definition of electrical junction potential of a device in fluidic continuity.

BRIEF DESCRIPTION OF THE FIGURES OF THE DRAWINGS

The invention will be better understood and other advantages and specific features will become clear on reading the description that follows, given by way of non limitative example, with reference to the accompanying drawings, in which.

DETAILED DESCRIPTION OF SPECIFIC EMBODIMENTS

The present invention draws its inspiration from the structure and the mode of operation of a calligraphic pen. The planar sources that are the subject of the present invention are constituted of the same elements as a calligraphic pen: a liquid reservoir and a two dimensional capillary slot formed in a tip. The present invention may comprise, if necessary, an electrical contact zone to which is applied the voltage necessary for establishing a nebulisate. This contact zone may be structured with multiple and independent contacts and, in particular, three contacts corresponding to a working electrode, also enabling the electrospray voltage to be applied, a reference electrode and a measurement electrode to allow the chemical modification by electrochemistry with a view to favouring the electrospray process or to study it. These electrodes also enable the control of the electrospray process by synchronisation on its own frequency. In the same way that in the calligraphic pen the liquid is conveyed by capillarity in the slot towards the end of the tip of the dip pen type structure where it is ejected. The ejection takes place not by mechanical action, but in the form of nebulisation by application of a high voltage to the liquid.

Figure 1A:
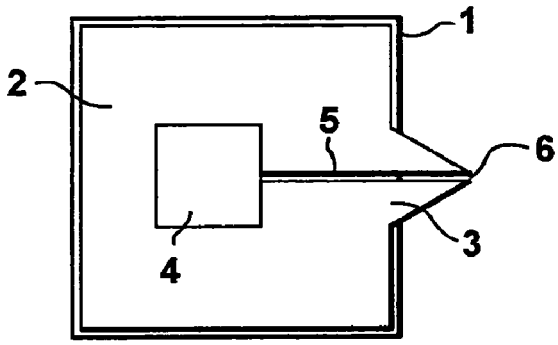
FIGS. 1A and 1B are respectively top and side views of an electrospray source according to the present invention.
Figure 1B:
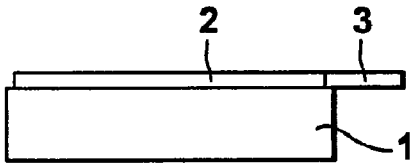

An electrospray source according to the present invention is represented in FIGS. 1A and 1B, FIG. 1A being a top view and FIG. 1B a side view.

This electrospray source comprises a support 1 and a wafer 2 integral with the support 1. A part of the wafer 2 forms a tip 3 in cantilever in relation to the support 1. The wafer 2 comprises in its centre a recess 4 revealing the surface of the support 1 and constituting a reservoir. A capillary slot 5, also revealing the support 1, connects the reservoir 4 to the end 6 of the tip 3, which forms an ejection orifice for the electrospray source.

The operation of the device is based on the following formulated principles. The reservoir of liquid 4 contains the liquid or serves as transit for the supply with liquid. The liquid is then guided by the capillary slot 5 upstream of which is located the reservoir 4 of liquid. The tip of the structure enables the establishment of an electrospray.

The following mode of operation ensues from this. The liquid of interest is deposited or conveyed into the reservoir of liquid 4 by an appropriate method. It is guided towards the end 6 of the structure by capillarity. The source is brought to its site of use (for example in front of a mass spectrometer). A potential is applied to the liquid so as to observe the nebulisate at the end 6 of the tip.

Figure 2:
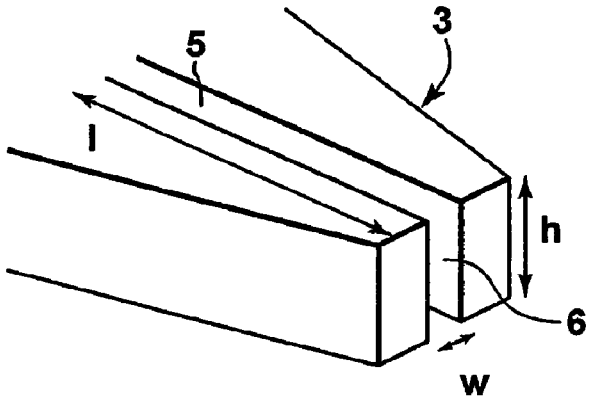
FIG. 2 is a perspective view of the end of the tip of an electrospray source according to the present invention.

The physics of the source having a dip pen type geometry is based on the properties of the materials that constitute it and the dimensions of its different elements. FIG. 2 represents a three dimensional view of the capillary slot at the level of the end 6 of the tip 3.

The role of the reservoir 4 is to contain the liquid to be nebulised and to progressively supply the capillary slot 5. The topology of the structure is two dimensional. The wafer 2 is in a material with hydrophobic character, and even more hydrophobic than that constituting the support 1 supporting the wafer 2, material that covers the base of the reservoir. This makes it possible to limit the losses of liquid outside of the reservoir. It is interesting to note in this respect that the liquids envisaged for the nebulisation are a priori of rather hydrophilic character, such as purely aqueous solutions or half-aqueous half-alcoholic solutions, for example 50/50 methanol/water mixtures.

The capillary slot 5 and the end 6 of the tip 3 are formed in the material forming the wafer 2 and their dimensions are determined during the manufacturing method. In FIG. 2 are indicated the dimensions to consider for the operation of the electrospray source: the width w of the slot, its height h and its length l. One assumes that the liquid is present in the capillary slot 5. When the electrospray source is presented opposite the zone where the nebulisation is desired, the effect of gravity on this liquid is negligible. The factors that are going to intervene for the filling of the capillary slot by the liquid are: the contact angle ($\alpha$) of the liquid on the material constituting the wafer 2, the surface tension ($\gamma$) of the liquid and the dimensions (l and h) of the capillary slot 5. According to equation 1, governing the capillarity effect of a liquid in a capillary tube, the cosine of the contact angle $\alpha$ must be positive in order to observe the capillarity effect, and this, independently of the effect of gravity.

$$h_r = \frac{2\gamma\cos\alpha}{\rho g r} \quad \text{(Equation 1)}$$

where (r) is the internal radius of the capillary, ($h_r$) the height to which the liquid rises in the capillary tube, (ρ) the density of the liquid, (α) is the contact angle of the liquid on the internal walls of the capillary tube and (g) is the acceleration of gravity.

$$\gamma \cos \alpha = \gamma_{SV} - \gamma_{SL} \quad \text{(Equation 2)}$$

where $\gamma_{SV}$ is the surface tension at the solid-vapour interface and $\gamma_{SL}$ is the surface tension at the solid-liquid interface.

Firstly, in the case where $\alpha<90°$ ($\cos \alpha>0$), Young's equation (equation 2) implies that $\gamma_{SV}>\gamma_{SL}$ and therefore that the solid-liquid interaction is favoured compared to that of the solid-vapour. The term r appears in equation 1. The observation or not of the capillarity effect depends on its value. The term r corresponds to the radius of the capillary tube and, in the case of the device that is the subject of the present invention, to the dimension of the capillary slot 5. If the liquid penetrates into the capillary slot, a liquid bridge between the two walls of the capillary slot is formed. One may thus define an aspect ratio R for the capillary slot 5, corresponding to the ratio h/w. It ensues from the preceding that R must be greater than a critical value to observe a capillarity effect in the capillary slot 5 and so that the formation of the liquid bridge in the capillary slot 5 is favoured from an energetic point of view.

Figure 3A:
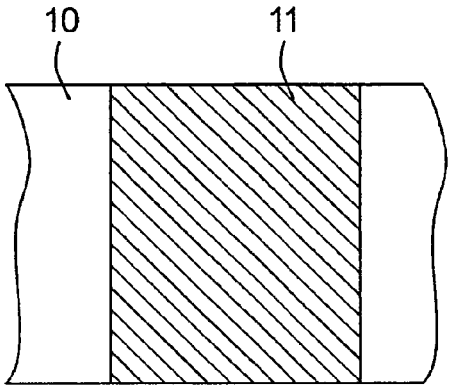
FIGS. 3A to 3H are top views illustrating a manufacturing method of the electrospray source represented in FIGS. 1A and 1B, FIGS. 4A and 4B illustrate a cleavage technique that can be used for implementing the manufacturing method illustrated by FIGS. 3A to 3H.
Figure 3B:
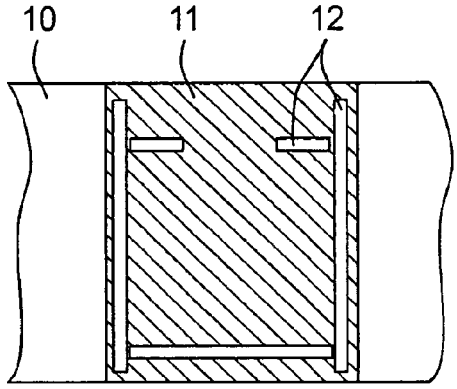
Figure 3C:
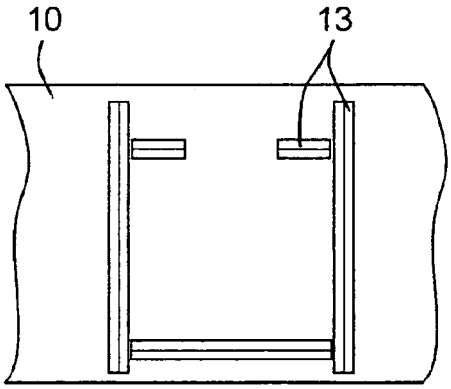
Figure 3D:
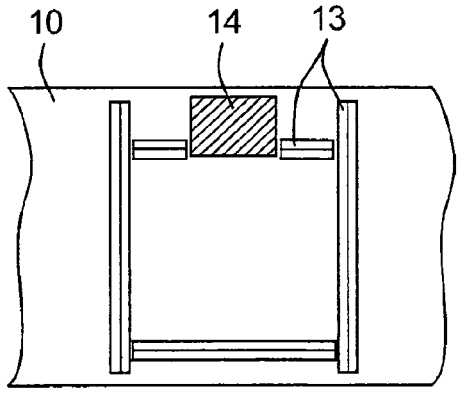
Figure 3E:
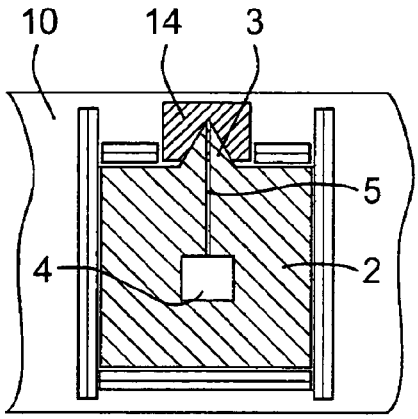
Figure 3F:
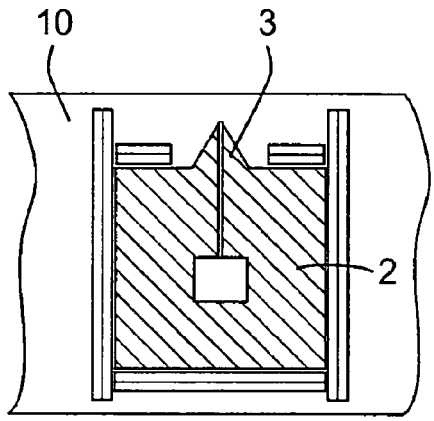
Figure 3G:
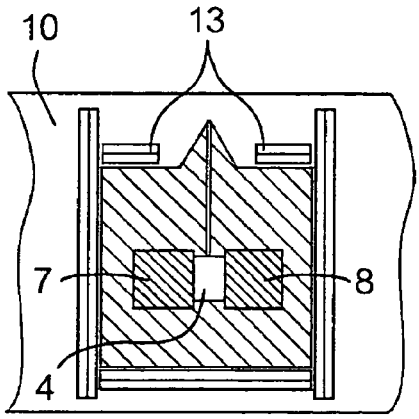
Figure 3H:
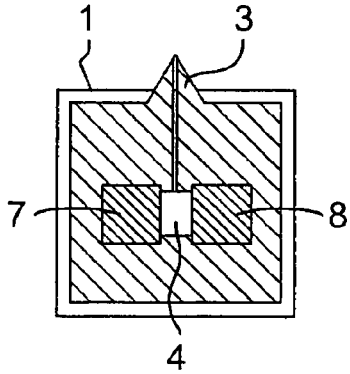

The nebulisation device may include or not conductive zones (see FIG. 3H). These conductive zones, if they are located at the level of the reservoir of liquid 4, serve as electrodes for conveying the nebulisation voltage. On the other hand, if they are located at the level of the capillary slot 5, these electrodes will serve to modify the species present in the liquid. In the case of an electrospray type application before analysis by mass spectrometry, electrochemical processes intervene during the ionisation of the molecules. The conductive zones located on either side of the capillary slot 5 at the level of the end 6 of the tip 3 make it possible to study them. Moreover, these phenomena lead to an increase in the ionisation efficiency and, as a result, an improvement in the analysis conditions. In the case of a molecular writing type application, the presence of a higher quantity of radical species increases the rate of etching of the substrate.

Nevertheless, depending on the nature of the material chosen to form the support 1 of the electrospray source, these conductive zones, in particular if their role is to convey the nebulisation voltage, may not be necessary. Indeed, if a conductive material (metal, Si, etc.) is used to form the support 1 or the wafer 2, the voltage will be applied directly to this conductive material. Finally, a device not comprising conductive zones and for which the materials are not conductive may be used in electrospraying provided that the electrical contact is achieved via the liquid. A metallic wire immersed in the solution to be nebulised, at the level of the reservoir 4 or any other conductive contact will thus assure the role of application of the nebulisation voltage.

The device may also be connected to a liquid supply source upstream of the reservoir 4, such as a capillary conveying a solution coming from another apparatus, another structure. For example, for a mass spectrometry type application, the capillary may correspond to a separation column output. For a deposition of drops of calibrated size or molecular writing type application, this capillary conveys the liquid towards the nebulisation device from its initial location. Said capillary may be a conventional commercial capillary in fused silica. It may also be a microfabricated capillary, in other words a microchannel integrated on the system supporting the source. The capillary may be a hydrophilic track materialised on the support 1. In these two latter cases, the wafer 2 is integrated on a fluidic microsystem and plays the role of interface between said microsystem and the exterior world where the solution exiting the microsystem is used. Finally, the conductive properties of the device or one of its elements may be used to electrically supply any system in fluidic relation with the device.

Moreover, said dip pen type wafers may be used in an isolated manner or be integrated in large numbers on a same support, and this with a view to the parallelisation of the nebulisation. In this case, said dip pen type wafers are independent or not of each other and the nebulised solutions are, either the same in order to increase the nebulisation of said solution, or different and, in this case, the dip pens function in a sequential manner in nebulisation. The integration of said dip pen type wafers may be carried out in a linear manner with an alignment of said wafers on a side of the support or in a circular manner on a round support. Going from one source to another is then achieved respectively by translation or by rotation of the support.

A wide range of materials may now be envisaged for microtechnological manufactures and in particular fluidic microsystems: glass, silicon based materials (Si, $SiO_2$, silicon nitride, etc.), quartz, ceramics and a large number of macromolecular materials, plastics or elastomers.

The geometry retained for the present invention is compatible with manufactures using any type of materials, and, for the different parts comprising the electrospray source: the support 1, the dip pen type wafer 2 and the conductive zones. Moreover, the method of technological manufacture involves one or several other material(s), the choice of which is adapted as a function of the materials retained for the elements 1, 2 and 3.

A generic method of manufacturing electrospray sources according to the invention is represented in FIGS. 3A to 3H. This manufacturing method may be broken down into seven major steps that are detailed below, so as to be applicable to any type of material.

The first step of this method of manufacture is the choice of the substrate intended to constitute the support of the electrospray source. This substrate 10 (see FIG. 3A) may be in macromolecular material, in glass or even in silicon or even in metal. In the case of this embodiment, it is a silicon substrate 250 μm thick.

The start of the method conditions the end of the manufacture of the electrospray devices. It involves the materialisation on the support of the device of lines that will aid the cleavage of the substrate in order to free the tip of the source and enable the nebulisation.

According to the second step, a layer 11 of material known as a protection layer is deposited on a part of the substrate 10. The material of the layer 11 is chosen as a function of the nature of the material of the substrate 10 in such a way that an attack of the layer 11 does not affect the substrate 10. In this embodiment, the layer of protective material is a layer of silicon oxide of 20 nm thickness. The layer 11 is of variable thickness depending on the nature of the materials of the substrate 10 and the layer 11. The layer 11 is subjected to a lithography step intended to reveal the zones of the substrate to be attacked to define cleavage lines delimiting the support of the structure. The corresponding zones of the layer 11 are attacked in order to provide openings 12 revealing the substrate 10 (see FIG. 3B). Once these zones of the substrate are revealed, they are subjected to an appropriate attack so as to materialise the cleavage lines 13. Finally, the remaining layer 11 is eliminated. FIG. 3C shows the result obtained: the lines 13, constituted of trenches of V section, delimiting the support of the structure to be obtained.

During a third step, a layer of sacrificial material is deposited on the substrate 10. This layer of sacrificial material 14 will enable at the end of manufacture the tip of the structure to overhang its support before the cleavage operation. The substrate 10 is covered with a thin film of sacrificial material of sufficient thickness so that, after its elimination, the tip is sufficiently separated from the substrate 10, but nevertheless sufficiently thin in order to do away with any problem of stressing and curving of the tip overhanging the support. In this embodiment, the layer of sacrificial material is a layer of nickel 150 nm thick.

The layer of sacrificial material is then subjected to a lithography step and appropriate attack in order to only retain of this material a zone 14 corresponding to the tip of the structure (see FIG. 3D).

The fourth step may be implemented. The substrate 10 is then covered with a layer of a material intended to constitute the wafer of the structure. As a function of the material of the substrate, the material of this layer may be silicon or based on silicon, a metal or even a polymer or ceramic type material. In this embodiment, the layer of material intended to constitute the wafer is a layer of 35 μm thickness in SU-8 2035 polymer purchased in pre-polymerised form from Microchem and polymerised by a photolithographic method. The thickness of this layer is chosen in an appropriate manner. Indeed, the ionisation performance of the nebulisation device depends on this thickness, as has been explained previously. The thickness of this layer influences directly the height h of the capillary slot and, according to the preceding, the bigger h is, the bigger w has to be in order not to modify the ratio R. However, depending on the final application of the nebulisation source, the challenge is to reduce was far as possible in order to increase the performance. On the other hand, if the thickness of the layer intended to constitute the wafer is too thin, the overhanging tip may bend once disbanded from the support due to the stresses applied to the material. Those skilled in the art will be capable of adapting the present specification as a function of the nature of the material of this layer and thus define the optimal thickness of material to be deposited.

This layer then undergoes a lithography step and an attack in order to form the dip pen type wafer 2, in other words in addition to its size, the reservoir 4, the capillary slot 5 and the tip 3 (see FIG. 3E). This attack is adapted as a function of the material of the wafer. It may involve a technique of chemical etching, a physical attack in the case of a material based on silicon or a metal, a physical attack or a photolithography followed by a development in the case of a photolithographic polymer.

The fifth step may then be undertaken. Once the wafer 2 has been formed, the zone 14 of sacrificial material under the tip 3 may be removed. The sacrificial material is removed by a suitable chemical attack. The solution for this chemical attack must be chosen judiciously so that all of the sacrificial material is eliminated without either the support or the wafer being affected. The materials of these elements must not be sensitive to this chemical solution. One obtains the structure shown in FIG. 3F.

The sixth step concerns the implantation of conductive zones on the structure. As mentioned previously, this step is only included in the method of manufacture if such conductive zones are provided for.

Whether these zones are located at the level of the reservoir 4 (application of the nebulisation voltage) or at the level of the tip (physical/chemical study electrodes), the manufacturing method is the same. The formation of conductive zones 3 at the level of the reservoir alone will be detailed here.

These conductive zones may be in metal or in carbon. The structure is firstly subjected to a masking step so that only the zones corresponding to the formation of conductive zones are cleared. The conductive material chosen is then deposited by a PECVD (Plasma Enhanced Chemical Vapour Deposition) technique on the structure. In this embodiment, the conductive zones are in palladium and have a thickness of 400 nm. FIG. 3G shows the structure obtained. Two conductive zones 7 and 8 flank the reservoir 4 and enable an electrical potential to be applied there.

The seventh step of this method of manufacturing the nebulisation source is the detachment of the support 1 in relation to the substrate 10 and, in particular, the placing in cantilever of the tip 3 in relation to the support 1 by using the cleavage lines 13 materialised in the second step of this manufacturing method. The structure obtained is represented in FIG. 3H.

Figure 4A:
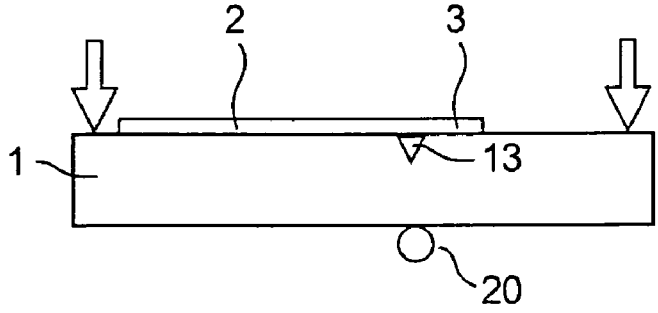
Figure 4B:
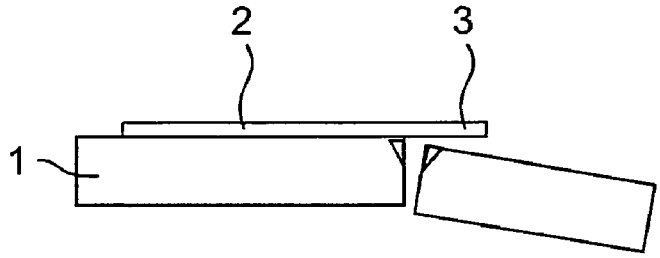

An advantageous cleavage technique is illustrated in FIGS. 4A and 4B in the case of the placing of the tip in cantilever. A fixed metallic wire 20 is placed under the support 1 at the level of the cleavage trenches 13 formed on either side of the tip. Two forces are jointly applied to the substrate at the locations indicated in FIG. 4A by arrows. The separation carried out beforehand of the tip 3 in relation to the support 1 thereby assures that the tip is not damaged during the cleavage step. FIG. 4B shows cleavage as it is taking place.

This generic manufacturing method is then adapted as a function of the materials chosen for each element of the electrospray source.

The first application field targeted by the present invention is the electrospraying of biological or chemical solutions to be analysed by mass spectrometry. Mass spectrometry is at the present time the technique of choice for the analysis, the characterisation and the identification of proteins. However, since the completion of the deciphering of the genome, biologists in particular have become more and more interested in proteomics, a science that aims to study and characterise all of the proteins of an individual. These proteins, in all human beings, are present in numbers of more than $10^6$ different molecules, including post-traductional modifications. This point justifies the need, at the present time, of analysis techniques and tools compatible with an automation with a view to a high rate analysis, and this particularly for mass spectrometry due to its pertinence within the scope of the study of proteins. The samples (or solutions to be analysed) that are available to the biologist are often of restricted size (less than or equal to 1 μL) and contain little biological material, which imposes working with a very sensitive analysis technique and consuming little of the sample. This makes mass spectrometry with an ionisation by nanoelectrospray one of the most widely used analysis techniques for the characterisation of proteins. In this context, the major challenge is the reduction, as far as possible, of the dimensions of the end of the tip of the source. Indeed, as mentioned in the introduction, two electrospray operating conditions for this type of application, the most interesting in terms of automation and gain in sensitivity being the nanoelectrospray operating condition. However, at the present time, the analysis speed is limited, the flow rate of samples restricted due to the fact that the nanoESI-MS (for "nano ElectroSpray Ionization-Mass Spectrometry") is entirely based on manual processes. The tools presently available do not lend themselves to a robotised and automated analysis. This context explains the motivations for the development of the present invention for this type of application.

The second type of application targeted by the present invention is the deposition of calibrated drops on a smooth or rough surface. This is of prime interest for the preparation of DNA, peptide and PNA chips or any other type of molecule. This type of application requires a device capable of conveying the fluid in discrete form, of drops of liquid of calibrated size, the size usually depending on the desired resolution in the preparation of the analysis wafers. The smaller the drops, the more their deposition on the wafer can be closer together and the higher the density of deposition and therefore the higher the density in substances to be analysed. The device that is the subject of the present invention may be used for this purpose. The width of the capillary slot 5, and the value of the applied voltage for the ejection of the drops conditions the size of the drops ejected by said nebulisation device. Thus the resolution of the analysis wafers may be adjusted as a function of the width of the slot of the device. Finally, the nebulisation voltage may be alternating and thus give a rate of deposition in drops/minute depending directly on the frequency of the alternating voltage. The deposition of calibrated drops as presented above may be used for the preparation of analysis wafers such as DNA chips. It may also be applied to the preparation of MALDI targets (for "Matrix-Assisted Laser Desorption/Ionization") on which the samples to be analysed by mass spectrometry with a MALDI ionisation here, are deposited in a discrete manner before their crystallisation and their introduction into the mass spectrometer. Thus, the present nebulisation device having a dip pen type geometry may be for example connected to a separation column output and enable a coupling between a separative technique and an in line MALDI type analysis by mass spectrometry. The drops of liquid finally may be replaced by cells. In this case, the cells are similarly ejected in a discrete manner and deposited for example on a wafer with a view to the elaboration of cell chips.

The third application targeted by the present invention is molecular writing at scales of around one hundred nanometers. At the present time, this type of operation is carried out by means of AFM tips, functioning by means of a heavy and bulky apparatus. The ejection of the liquid is based on a bringing into contact or quasi-contact of the tip and the deposition substrate in the case of AFM or on the application of a pressure on the liquid. An adaptation of this technique is to eject the liquid under the action of a voltage and not by means of a pressure or a bringing into contact. Indeed, in both cases, the ejection is induced when the tension forces of the liquid at the level of the tip of the pipette are "exceeded" by another force applied to the column of liquid. This may be envisaged with an electrospray device where the electrical force exceeds that of the liquid tension and thus leads to the formation of droplets. Furthermore, the formation of reactive species is intrinsic to the electrospray process. This fluid ejection technique does away with any complex apparatus for producing reactive species such as free radicals, such as a plasma or microwave discharge, upstream of the structure that delivers the liquid.

The present invention may therefore be used for such writing purposes on a smooth or rough substrate, the liberation of the writing solution (pseudo-ink) here being governed by application of a voltage. In the same way as for the first application field, a major challenge is to minimise the size of the end of the tip, this dimension conditioning the size of the ejections by nebulisation and consequently the desired writing resolution on the final substrate. The width of the tip is less than or equal to a micrometer. Another factor influencing the size of the ejections and the fluid flow rate is the nebulisation voltage applied to the liquid. Finally, the production of reactive species, if the device is used to dispense a solution for attacking the substrate, may be enhanced with the implantation of electrodes within the dip pen type structure that conveys the fluid. These electrodes are then the site of electrochemical reactions leading to the formation of reactive species We will now interest ourselves in the following examples.

EXAMPLE 1

Design of Nanoelectrospray Sources Microfabricated According to the Present Invention A first example concerns the dimensions and the shapes chosen to form a nebulisation device as described in the present invention.

This first device has small tip dimensions due to the targeted application field, in other words a nanoelectrospray for the ionisation of solutions before their analysis by mass spectrometry. The device is formed in accordance with FIGS. 1A and 1B. The reservoir 4 of the device has for dimensions 2.5 mm×2.5 mm×e (μm), where e is the thickness of the layer of material used to form the wafer 2. The value of e is close to that of h, considered hereafter, the thickness of sacrificial material being around one hundred nanometers. The width of the capillary slot 5 is 8 μm at the end 6 of the tip 3. The thickness of the wafer 2 so as to observe the capillarity effect and the effective penetration of the liquid in the capillary slot 5 follows from the value of the slot width. This is governed by the value of the parameter R defined as the ratio between the height h and the width w of the slot, R=h/w. It appears that this ratio must be greater than 1 so that the capillarity effect is observed. Thus, the thickness of the wafer must be greater than ten or so micrometers. Moreover, to free oneself of problems of mechanical constraints that result in a curving of the structure at the end 6, this thickness has been set at 35 μm.

EXAMPLE 2

Manufacture of Design Sources Described in Example 1 by Means of Silicon and SU-8 Materials The second example concerns the manufacture by microtechnology of nebulisation sources, as described in example 1. The materials used are silicon for the support 1 and the negative photolithographic resin SU-8 for the dip pen type wafer 2. The method of manufacture stems from the method described above. It is adapted to the materials chosen.

A substrate of silicon oriented (100) and n doped, of 3 inches, is covered with a layer of 200 nm of silicon oxide ($SiO_2$), then masked by lithography. The layer of $SiO_2$ is attacked by an acid solution of $HF:H_2O$ on the non-masked zones. The exposed silicon is then attacked by a caustic soda solution (KOH) so as to materialise the cleavage lines. A layer of 150 nm of nickel is then deposited on the silicon surface by a spraying technique under argon (Plassys MP 450S). The layer of nickel is attacked in a local manner by UV photolithography (positive photosensitive resin AZ1518 [1.2 μm], etching solution $HNO_3/H_2O$ (1:3)) so that nickel only remains under the tip of the dip pen. After elimination of any trace of photolithographic resin, the wafer of silicon is dehydrated at 170° C. for 30 min, so as to optimise the adhesion of the resin SU-8 on the silicon surface. A layer of 35 μm of resin SU-8 is spread out on the silicon substrate by means of a whirler to homogenise the thickness before the following step of photolithography. The dip pen type wafer 2 is formed in this layer of resin SU-8 by means of conventional UV photolithography techniques. After development of the resin SU-8 with the appropriate reagent (1-methoxy-2-propanol acetate, PGMEA), the layer of nickel is attacked with the acid solution ($HNO_3/H_2O$) described above. This step of chemical attack of the nickel does not affect the resin SU-8 even if this method can take several hours. Finally, after drying of the device, the silicon substrate 1 is sawed according to the technique illustrated in FIGS. 4A and 4B. The technique used here preserves the structure of the dip pen, since it has been disbanded from its support beforehand. A scanning electron microscope photograph (Hitachi S4700) of the dip pen type nebulisation source manufactured according to this method confirms the correct disbanding of the tip in relation to its support.

The method of manufacture described above does not include the formation of electrodes.

EXAMPLE 3

Design of Particle Ejection Device of Around One Hundred Micrometers

A third example concerns the dimensions and the shapes chosen for forming a particle ejection device having a size of around one hundred micrometers, as described in the present invention.

This device has larger dimensions than that described in example 1. Here, the dimensions of the capillary slot 5 and the reservoir 4 must be compatible with the handling of objects of around one hundred micrometers. Due to this range of dimensions, the device described in example 3 also applies to the handling of cells of size close to 100 μm diameter, for the preparation of cell chips for example.

The reservoir 4 of said device has for dimensions 1 cm×1 cm×e (μm), where e is the thickness of the wafer 2. In the same way as example 1, the value of e is defined as a function of the width of the capillary slot 5 so as to have an aspect ratio R in the end 6 of the wafer that is greater than 1. The particles handled by this device have a size of around one hundred micrometers, therefore the capillary slot 5 has to have a width greater than 100 μm. However, since the particles may have a tendency to aggregate, this width must not be chosen too large. It is preferably close to double the size of the particles handled. As a result, the width of the slot is fixed at 150 μm, and the thickness of the wafer at 200 μm.

The material retained for the manufacture of the dip pen type wafer 2 is here again the negative photolithographic resin SU-8 and the material chosen for the support 1 is glass. The resin SU-8 is interesting here for handling particles such as cells, because these cells do not adhere to this material. As a result, the support 1 in glass is itself also covered with a thin film of resin SU-8 in order to prevent any non desired adhesion of cells on the device.

EXAMPLE 4

Figure 5:
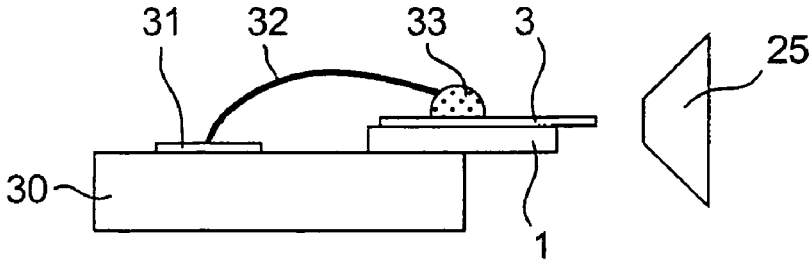
FIG. 5 represents an assembly used during a test in the course of which an electrospray source according to the invention is associated with a mass spectrometer.

Test of Nebulisation Sources Manufactured According to Example 2 by Mass Spectrometry. I: Application of the Voltage by Means of a Platinum Wire Example 4 is the test of nebulisation sources manufactured as described in example 2 for a mass spectrometry analysis. In this first example, the nebulisation voltage is applied to the liquid to be nebulised by means of a platinum wire immersed in the liquid at the level of the reservoir as illustrated in FIG. 5.

The nebulisation device is placed on a mobile part 30 that can be displaced in xyz. This mobile part 30 comprises a metallic part 31 to which is applied the ionisation voltage in the mass spectrometer 25. The silicon support 1 is isolated as a precautionary measure from this metallic part 31 during the fixation of the device on said mobile part 30 due to the semi-conductive properties of this material. The electrical contact between the metallic part 31 and the reservoir of the device is assured by means of a platinum wire 32 introduced in the reservoir and which is immersed in the solution to be analysed 33. The solution used for the nebulisation tests, a solution of standard peptide (Gramicidine S), is deposited in the reservoir of the device and the mobile part 30 is introduced in the input of the mass spectrometer 25. The tests are carried out on a from Thermo Finnigan ion trap type mass spectrometer (LCQ DECA XP+). The voltage is then applied to the liquid. A camera installed on the ion trap enables the Taylor cone to be visualised, once the voltage is applied. The capillary slot has a width of 8 μm.

Figure 6:
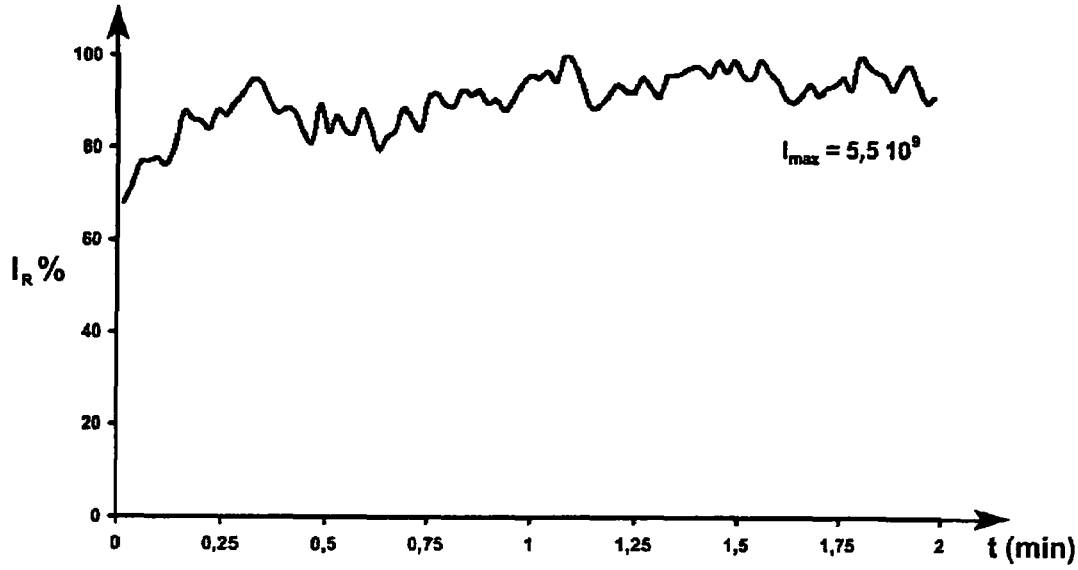
FIG. 6 is a graph representing the total ion current obtained during the test using an electrospray source according to the invention, in the assembly of FIG. 5.
Figure 7:
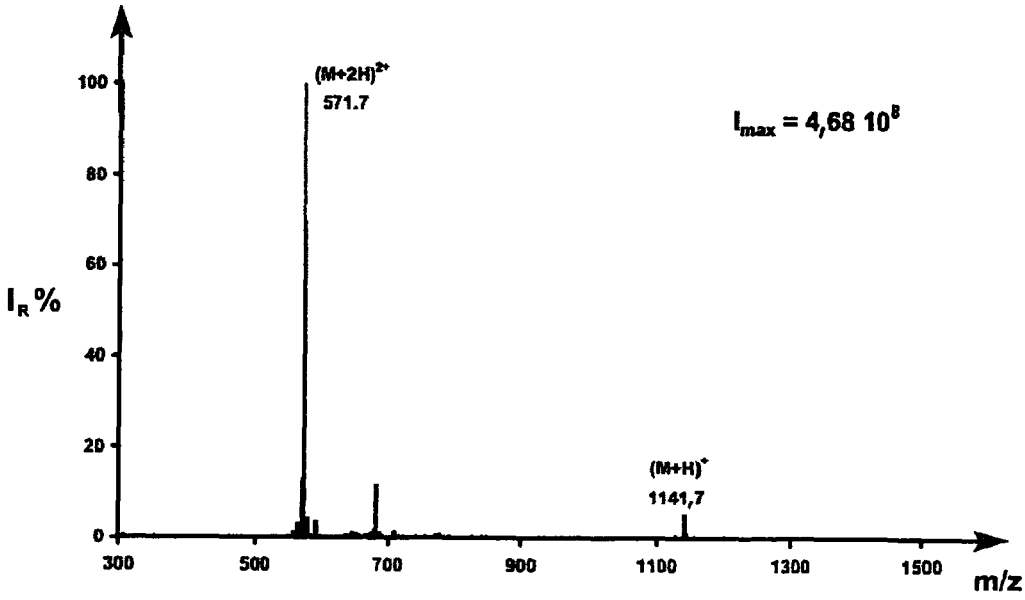
FIG. 7 is a mass spectrum obtained during the test using an electrospray source according to the invention in the assembly of FIG. 5.

FIG. 6 is a graph representing the total ion current recorded by the mass spectrometer for an experiment conducted over 2 minutes with a 5 μM solution of Gramicidine S and an ionisation voltage of 0.8 kV. The Y-axis represents the relative intensity $I_R$. The X-axis represents the time. FIG. 7 corresponds to the mass spectrum obtained with a 5 μM solution of Gramicidine S and a voltage of 1.2 kV. The mass spectrum has been averaged out over a 2 minute signal acquisition, i.e. 80 scans.

EXAMPLE 5

Test of Nebulisation Sources Manufactured According to Example 2 by Mass Spectrometry. II: Application of the Voltage to the Silicon Support Example 5 is similar to example 4, but here the voltage is not applied by means of a platinum wire but by exploiting the semi-conductive properties of silicon.

Example 5 is therefore the test by mass spectrometry of nebulisation sources manufactured according to example 2 with an application of the ionisation voltage to the material constituting the support 1 of the nebulisation device.

In the same way as previously, the nebulisation device is fixed on a mobile part 40 that can be displaced in xyz and having a metallic part 41. Here, the silicon support 1 is brought into electrical contact with the metallic part 41 of the mobile part 40 to which is applied the ionisation voltage in the mass spectrometer 25. The device is fixed on the mobile part 40 by means of a Teflon tape, which surrounds the device upstream of the reservoir. The test is conducted as previously after introduction of the mobile part 40 in the ion trap 25 and application of the voltage. The capillary slot has a width of 8 μm.

Figure 9:
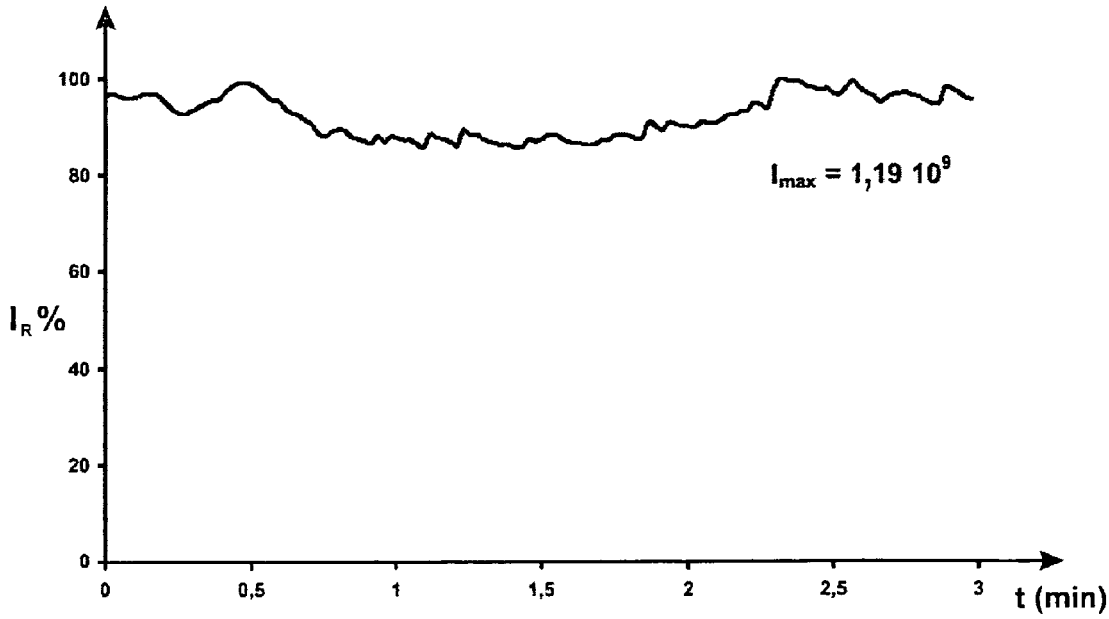
FIG. 9 is a graph representing the total ion current obtained during the test using an electrospray source according to the invention, in the assembly of FIG. 8.
Figure 10:
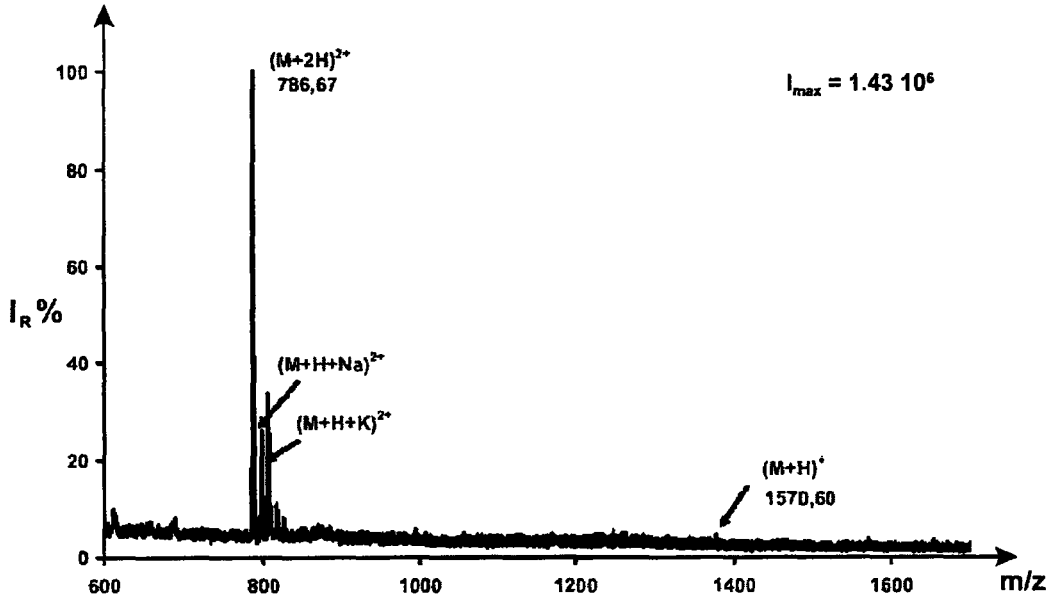
FIG. 10 is a mass spectrum obtained during the test using an electrospray source according to the invention in the assembly of FIG. 8.

The tests were conducted with another standard peptide, Glu-Fibrinopeptide B. The ionisation voltages, here, are in the same range as previously, from 1 to 1.4 kV for peptide concentrations less than 1 μM. FIG. 9 represents the total ion current measured over 3 minutes of acquisition of the signal with a 0.1 μM solution and a voltage of 1.1 kV. $I_R$ is the relative intensity and t the time. FIG. 10 is the mass spectrum obtained for this acquisition and averaged out over the period of 3 minutes, i.e. 120 scans. $I_R$ is the relative intensity.

EXAMPLE 6

Test of Nebulisation Sources Manufactured According to Example 2 by Mass Spectrometry. III: Fragmentation Experiment (MS/MS)

Figure 8:
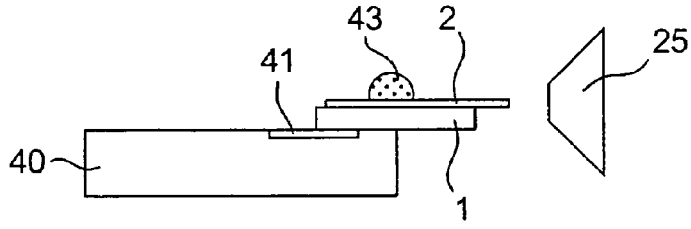
FIG. 8 represents another assembly used during a test in the course of which an electrospray source according to the invention is associated with a mass spectrometer.

Example 6 is identical to example 5 as regards the manner of conducting the test. The test assembly is identical to that of the previous example, the nebulisation device corresponds to that described in example 1 and carried out according to the method of manufacture described in example 2. The voltage is applied directly to the material of the support 1, silicon, via the metallic zone 41 included on the mobile part 40 introduced in the mass spectrometer 25 (see FIG. 8). The capillary slot has a width of 8 μm.

The solution is the same as previously, a solution of standard peptide, Glu-Fibrinopeptide B at concentrations less than or equal to 1 μM. Here, the peptide is subjected to a fragmentation experiment. The peptide in double charged form $(M+2H)^{2+}$ is specifically isolated in the ion trap and is fragmented (standardised collision energy parameter of 30%, radiofrequency activation factor set at 0.25).

Figure 11:
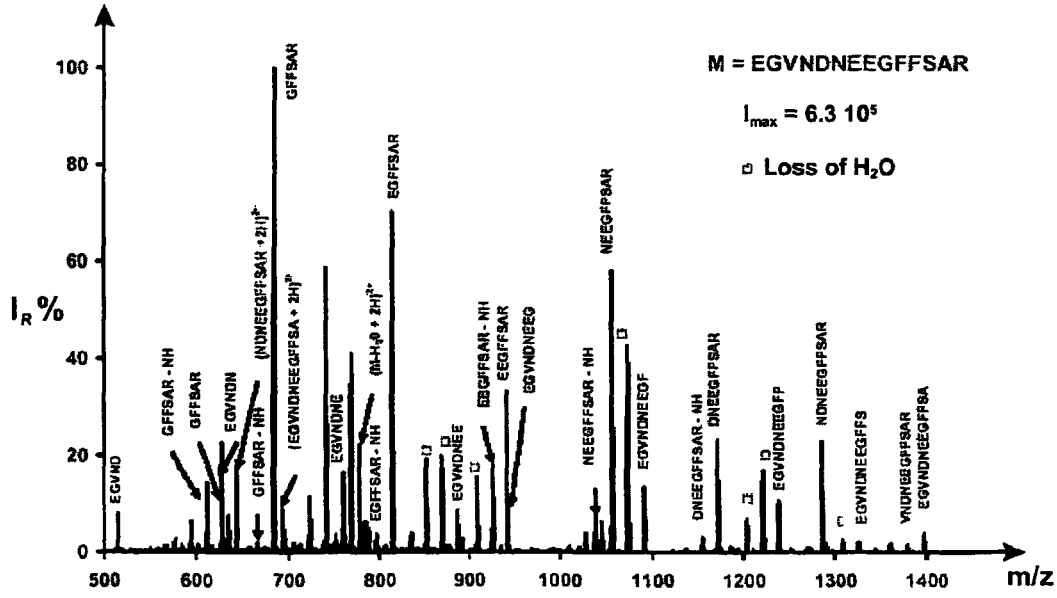
FIG. 11 represents a fragmentation mass spectrum of Glu-Fibrinopeptide obtained with an electrospray source according to the present invention.

FIG. 11 represents the fragmentation spectrum obtained during this experiment with a 0.1 μM solution and a voltage of 1.1 kV. $I_R$ is the relative intensity. The spectrum has been averaged out over 2-3 minutes of nebulisation acquisition signal. The different MS/MS fragments are annotated with their sequence.

EXAMPLE 7

Test of Nebulisation Sources Manufactured According to Example 2 by Mass Spectrometry. IV: Application to the Analysis of a Biological Mixture Example 7 is identical to example 5 (same device manufactured according to the same method and tested under the same conditions with application of the voltage to the silicon support 1) except that the sample analysed here is no longer a standard peptide but a complex mixture of peptides obtained by digestion of a protein, Cytochrome C. This digestate is composed of 13 peptides of different lengths and physical/chemical properties. This digestate is tested at a concentration of 1 μM and with an ionisation voltage of 1.1-1.2 kV. The width of the capillary slot is 8 μm.

Figure 12:
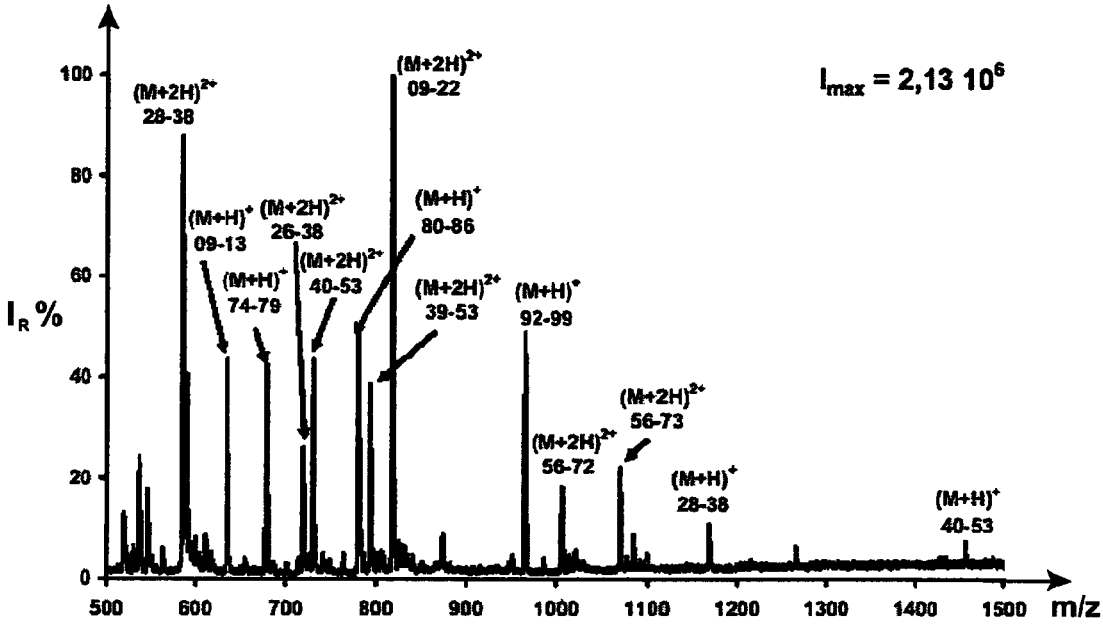
FIG. 12 represents a mass spectrum obtained for a digestate of Cytochrome C by the intermediary of an electrospray source according to the present invention.

FIG. 12 represents the mass spectrum obtained for the digestate of Cytochrome C at 1 μM with a voltage of 1.2 kV. $I_R$ is the relative intensity. The peaks are annotated with the sequence of the fragment and its state of charge. Out of the 15 peptides, 11 are clearly identified during this experiment.

EXAMPLE 8

Test of Nebulisation Sources Manufactured According to Example 2 by Mass Spectrometry. V: Continuous Supply of Said Device by Means of a Syringe Pump or a NanoLC Chain Placed Upstream Example 8 is identical to example 5 (same device manufactured according to the same method and tested under the same conditions with application of the voltage to the silicon support 1) except that the sample analysed here is continuously conveyed to said device by a capillary connected to a syringe pump or a nanoLC chain upstream.

For the coupling to a syringe pump, the flow of liquid has been fixed at 500 mL/min. The solution for this test is identical to that of example 5, except that the concentration of the peptide Glu-Fibrinopeptide B is here 1 μM and the nebulisation voltage has been set at 1.2 kV. The width of the capillary slot is 8 μm.

Figure 13:
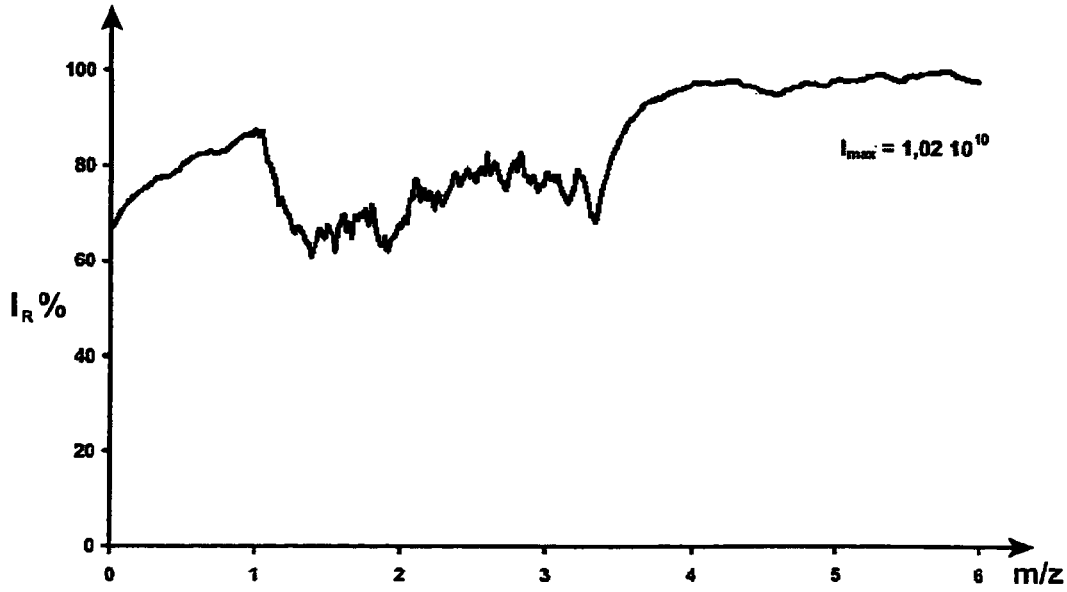
FIG. 13 is a graph representing the total ion current obtained during a test using an electrospray source according to the invention.
Figure 14:
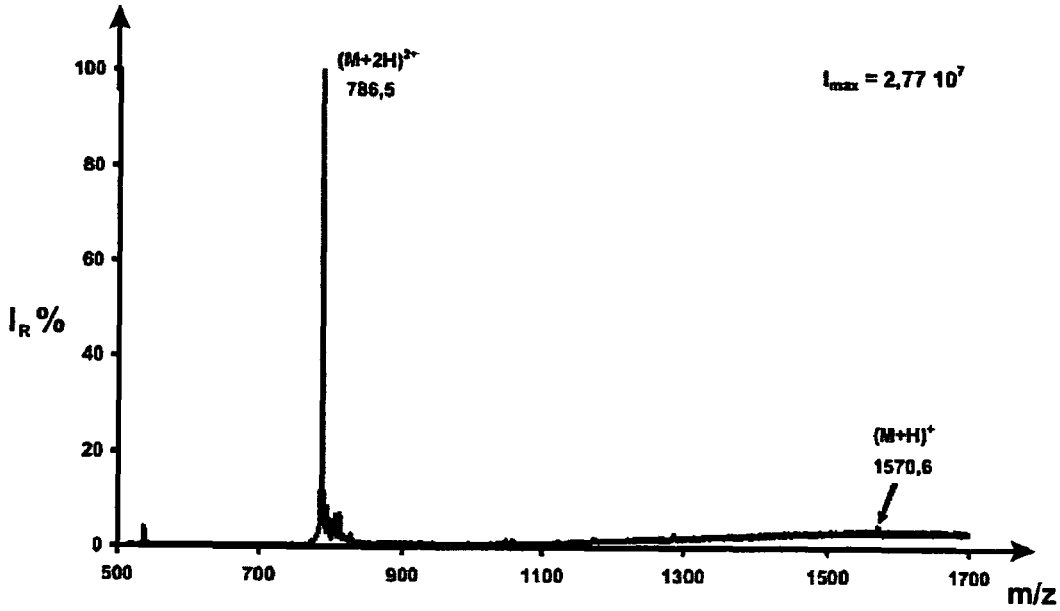
FIG. 14 represents a mass spectrum obtained during a test using an electrospray source according to the present invention.

FIG. 13 shows the total ion current recorded during a nebulisation test conducted over a period of 6 minutes under said conditions. $I_R$ is the relative intensity and t the time. FIG. 14 represents the corresponding mass spectrum averaged out over this acquisition period of 6 minutes, i.e. 240 scans. $I_R$ is the relative intensity.

Figure 15:
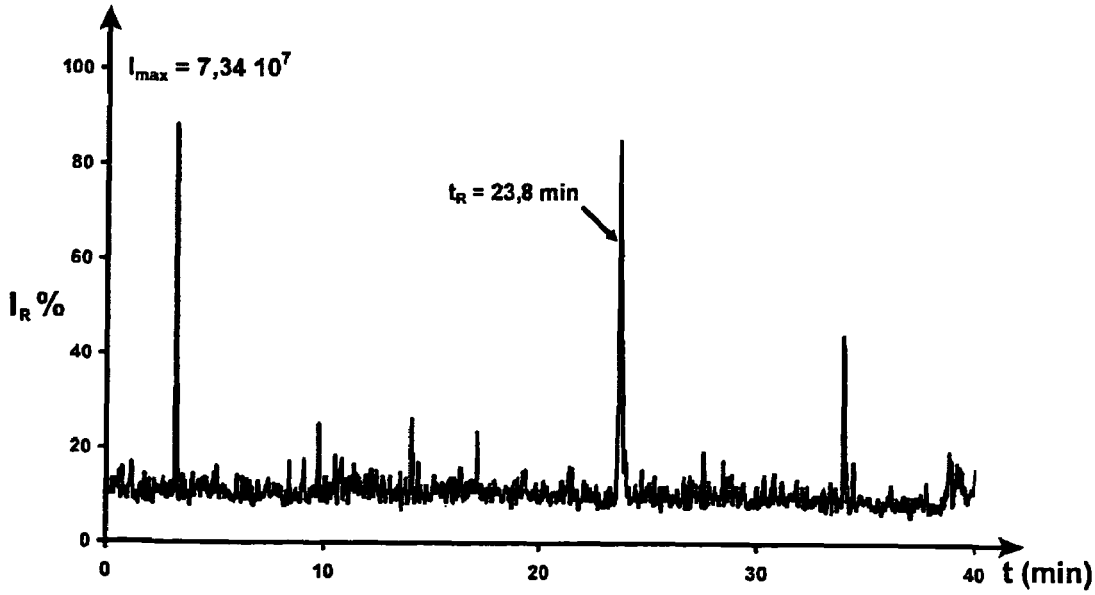
FIG. 15 is a graph representing the total ion current recorded on an ion trap type mass spectrometer during a coupling test using an electrospray source according to the present invention.
Figure 16:
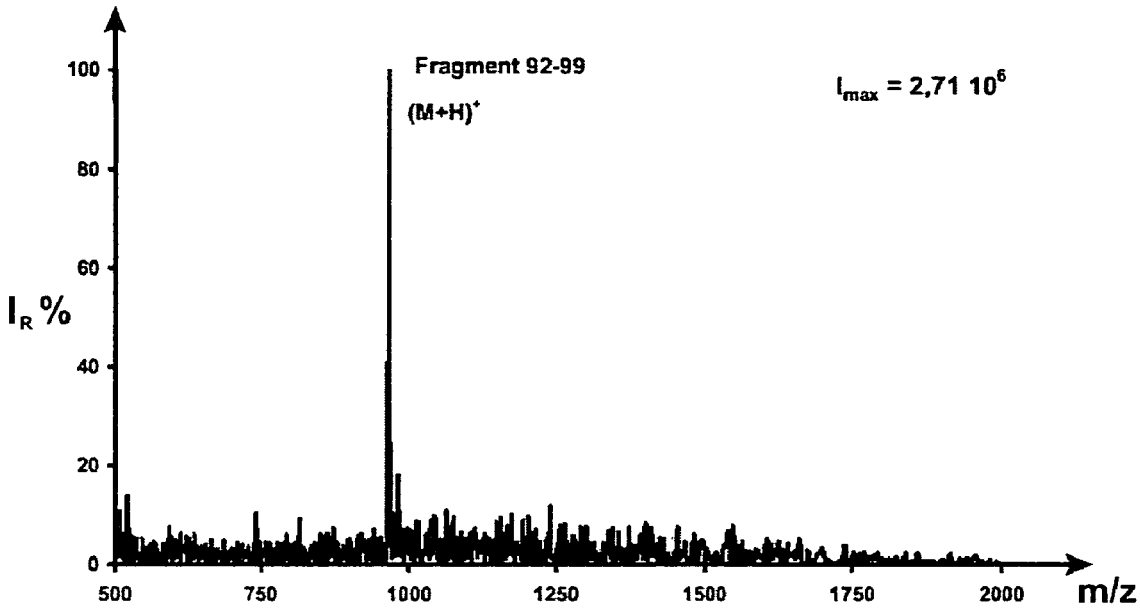
FIG. 16 represents the mass spectrum corresponding to the graph in FIG. 15.

The coupling to a nanoLC chain (liquid chromatography at a flow rate of 1 to 1000 nL/min) has been carried out with conventional conditions of coupling between a separation on nanoLC and an in line analysis by mass spectrometry on an ion trap. The fluid flow rate is 100 nL/min, the ionisation 1.5 kV. The separation experiment is carried out on a digestate of Cytochrome C at 800 fmol/μL and 800 fmol of this digestate are injected in the separation column. The width of the capillary slot is 10 μm. FIG. 15 represents the total ion current detected on the mass spectrometer during the separation experiment. $I_R$ is the relative intensity and t the time. FIG. 16 is the mass spectrum obtained for the peak indicated in FIG. 15 at the retention time of 23.8 min. It corresponds to the elution and the analysis of the fragment 92-99 of the Cytochrome C. $I_R$ is the relative intensity.

The invention claimed is:

1. Electrospray source having a structure which comprises;
a support having a main face;
a wafer formed on said main face of the support and integral with said main face of the support, a part of the wafer constituting at least one flat and thin tip cantilevered with respect to the support, said tip comprising a first face and a second face and being provided with a capillary slot formed through a complete thickness of the tip from said first face through said second face, said thickness being substantially orthogonal to the main face of the support, said capillary slot leading to an end of the tip to form an ejection orifice of the electrospray source, the electrospray source comprising means for supplying the capillary slot with liquid to be nebulised and means for applying an electrospray voltage to said liquid.

2. Electrospray source according to claim 1, wherein the supply means comprise at least one reservoir in fluidic communication with the capillary slot.

3. Electrospray source according to claim 1, wherein the supply means comprise a reservoir constituted by a recess formed in said wafer and in fluidic communication with the capillary slot.

4. Electrospray source according to claim 1, wherein the means of applying an electrospray voltage comprise at least one electrode arranged so as to be in contact with said liquid to be nebulised.

5. Electrospray source according to claim 1, wherein the means of applying an electrospray voltage comprise the support, at least partially electrically conductive, and/or the wafer at least partially electrically conductive.

6. Electrospray source according to claim 1, wherein the means of applying an electrospray voltage comprise an electrically conductive wire arranged in order to be able to be in contact with said liquid to be nebulised.

7. Electrospray source according to claim 1, wherein the supply means comprise a capillary tube.

8. Electrospray source according to claim 1, wherein the supply means comprise a channel formed in a microsystem supporting said structure and in fluidic communication with the capillary slot.

9. Electrospray source according to claim 1, wherein the wafer has a surface hydrophobic to the liquid to be nebulised.

10. Ionization of a liquid by electrospraying the liquid with the electrospray source of claim 1, and analyzing the changed liquid by mass spectrometry.

11. Producing drops of liquid of a calibrated or controlled size by electrospraying a liquid using the electrospray source of claim 1.

12. Carrying out molecular writing with chemical compounds by electrospraying chemical compounds using the electrospray source of claim 1.

13. Electrospraying a liquid using the electrospray source of claim 1 to define the electrical junction potential of a device in fluidic continuity.

14. Method of manufacturing a structure being an electrospray source, comprising:

the formation of a support from a substrate, the support having a main face, the formation of a wafer having a part constituting a flat and thin tip, said tip comprising a first face and a second face and being provided with a capillary slot, to convey a liquid to be nebulised, formed in a complete thickness of the tip from said first face through said second face and which ends up at an end of the tip, making said wafer integral on the main face of the support, the tip being cantilevered along a plane in relation to the support, wherein said thickness being substantially orthogonal to the plane.

15. Method according to claim 14, wherein it comprises the following steps:

the provision of a substrate to form the support, the delimitation of the main face of the support by means of trenches etched in the substrate, the deposition, on a zone of the main face of the substrate corresponding to the future tip of the structure, of sacrificial material according to a determined thickness, the deposition of the wafer on the main face of the support delimited in the substrate, the tip of the wafer being situated on the sacrificial material, the elimination of the sacrificial material, the detachment of the support in relation to the substrate by cleavage at the level of said trenches.

16. Method according to claim 15, wherein the step of deposition of the wafer is a deposition of a wafer comprising a recess in fluidic communication with the capillary slot in order to constitute a reservoir.

17. Method according to claim 15, wherein it further comprises a step of depositing at least one electrode intended to assure an electrical contact with the liquid to be nebulised.

* * * * *